US006171156B1

(12) United States Patent
Lin et al.

(10) Patent No.: US 6,171,156 B1
(45) Date of Patent: Jan. 9, 2001

(54) CONTACT FOR ELECTRICAL CONNECTOR FOR SUPPRESSING WICKING OF SOLDER

(75) Inventors: Nick Lin, Hsin-Chuang; Jack Lee, Tu-Chen; E-Feng Lo, Hsin-Chu, all of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/295,633

(22) Filed: Apr. 20, 1999

(51) Int. Cl.[7] ..... H01R 4/02
(52) U.S. Cl. ..... 439/876; 439/342
(58) Field of Search ..... 439/83, 876, 342, 439/259

(56) References Cited

U.S. PATENT DOCUMENTS 5,395,250 * 3/1995 Englert, Jr. et al. ..... 439/65
5,441,429 * 8/1995 Seidler ..... 439/876
5,791,929 * 9/1998 Banakis et al. ..... 439/342
5,934,951 * 9/1999 Lai et al. ..... 439/876
5,947,778 * 6/1999 Lai et al. ..... 439/876
6,056,576 * 5/2000 Szu ..... 439/342

* cited by examiner

*Primary Examiner*—Khiem Nguyen
*Assistant Examiner*—Hae Moon Hyeon
(74) *Attorney, Agent, or Firm*—Wei Te Chung

(57) ABSTRACT

A contact element of an electrical connector includes an anchoring section having barbs for securing the contact element in a bore defined in a connector and a pin engaging section connected to the anchoring section by a reduced connection section. An elongate projection is formed on the connection section and substantially extends therealong for blocking a wicking path between the anchoring section and the pin engaging section thereby suppressing wicking of solder and/or gold coating through the connection section. The projection may be simply formed by pressing the connection section. The projection may be replaced by an elongate opening.

12 Claims, 9 Drawing Sheets

CONTACT FOR ELECTRICAL CONNECTOR FOR SUPPRESSING WICKING OF SOLDER

BACKGROUND OF THE INVENTION

1. Field of the Invention

The present invention generally relates to a contact element retained in an electrical connector, and in particular to a contact element capable of effectively suppressing wicking of solder during a soldering process.

2. The Prior Art

Electrical connectors comprise contact elements made of conductive material retained in bores defined in an insulative housing for electrically engaging with pins of an electronic device inserted into the bores. Some electrical connectors, such as a mobile socket connector, comprise a movable cover and a fixed base. The contact elements are retained in bores defined in the base for being soldered to a circuit board. The cover defines holes corresponding to the bores of the base. An electronic device is positioned on the cover with pins thereof extending through the holes and partially into the bores whereby when the cover is moved with respect to the base, the pins are brought into engagement with the contact elements for establishing electrical engagement between the electronic device and the circuit board.

Each contact element of the connector comprises an anchoring section having barbs for fixing inside the corresponding bore and a loop section forming a resilient arm defining a narrow space. The loop section is connected to the anchoring section by means of a reduced connection section. A pin of the electronic device is initially received in the loop but does not make contact therewith. When the cover is moved, the pin is driven into the narrow space thereby securely engaging with the resilient arm.

One method of soldering the contact elements to the circuit board is to dip the circuit board into a molten solder bath or to dispose solder balls therebetween to be melted later. Molten solder flows into a gap formed between the contact elements and the circuit board and surrounds the contact elements thereby securing the contact elements to the circuit board after the solder is cured. During the soldering process, wicking of the molten solder from the anchoring section, through the neck section, to the loop section often occurs thereby adversely affecting electrical properties of the contact element.

Furthermore, the loop section which engages with the pin of the electronic device is often coated with a layer of gold for improving the conductivity thereof. Wicking of the gold layer to the anchoring section also commonly occurs. Although not affecting electrical properties of the contact element, such a method increases manufacturing costs since gold is a precious metal.

It is thus desirable to have a contact element capable of suppressing or eliminating the wicking problem.

SUMMARY OF THE INVENTION

Accordingly, an object of the present invention is to provide a contact element capable of suppressing solder wicking to a pin engaging section thereof during a soldering process.

Another object of the present invention is to provide a contact element capable of suppressing wicking of a surface of precious coating material of a pin engaging section to an anchoring section thereby reducing manufacturing costs.

To achieve the above objects, a contact element of an electrical connector in accordance with the present invention comprises an anchoring section having barbs for securing the contact element in a bore defined in a connector and a pin engaging section connected to the anchoring section by a reduced connection section. An elongate projection is formed on the connection section and substantially extends therealong for blocking a wicking path between the anchoring section and the pin engaging section thereby suppressing wicking of solder and/or gold coating through the connection section. The projection may be simply formed by pressing the connection section. The projection may be replaced by an elongate opening.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
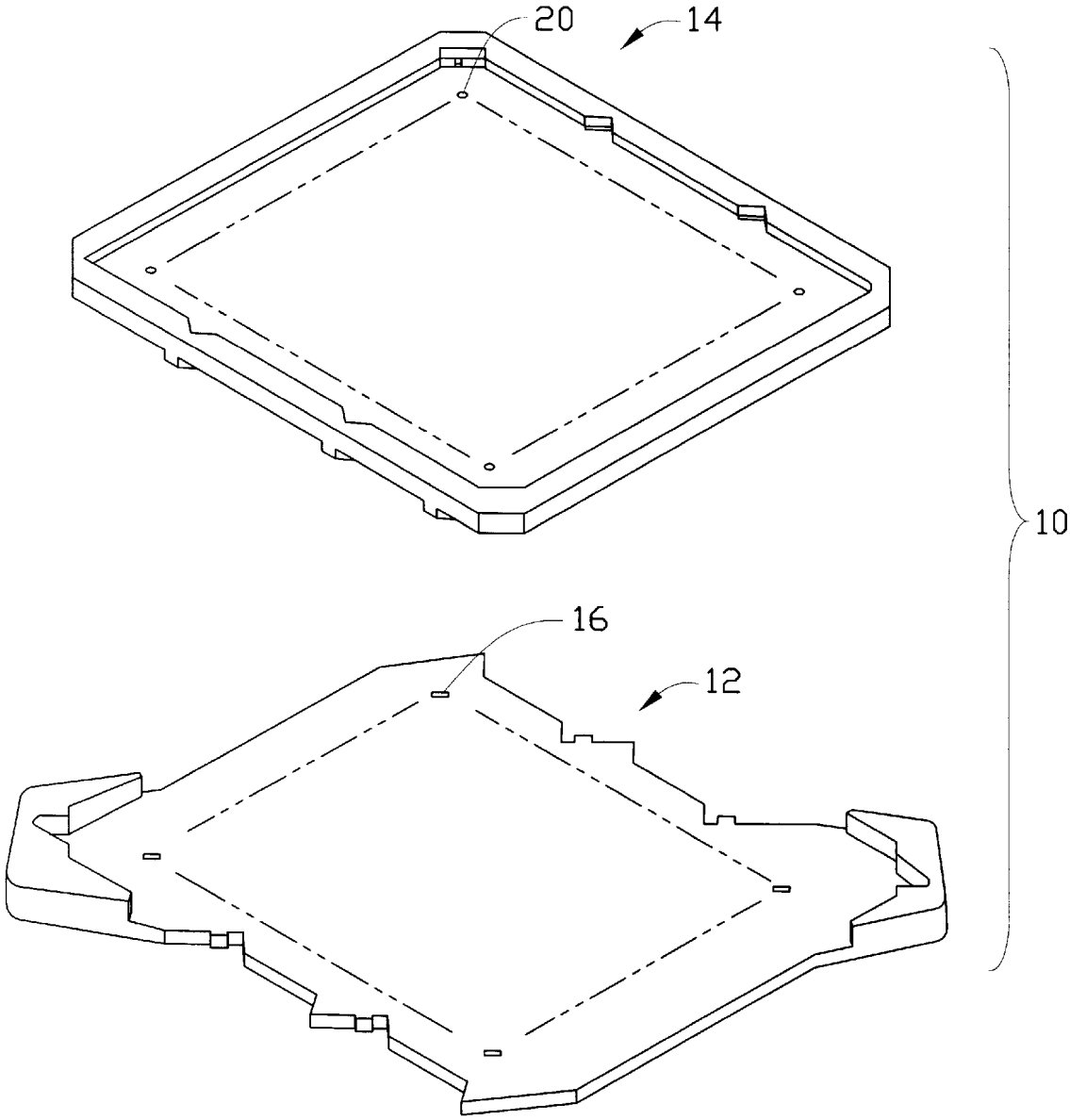
FIG. 1 is an exploded view of an electrical connector in which contact elements constructed in accordance with the present invention are retained.

It is noted here that for facilitating understanding, like components are designated by like reference numerals throughout the descriptions of the different embodiments of the present invention as shown in the attached drawing figures.

Referring to the drawings and in particular to FIG. 1, an electrical connector 10 comprises a fixed base 12 adapted to be mounted on a circuit board (not shown) and a movable cover 14 slidably mounted on the base 12. The base 12 and the cover 14 are both made of insulative material. The base 12 defines a plurality of bores 16 for each retaining a conductive contact element 18 (FIGS. 2 and 3) constructed in accordance with the present invention. The cover 14 is adapted to retain an electronic device (not shown), such as a central processing unit module, thereon and defines a plurality of through holes 20 for receiving pins of the electronic device. The pins extend through the holes 20 and partially into the corresponding bores 16 of the base 12 whereby when the cover 14 is moved with respect to the base 12, the pins are brought into engagement with the corresponding contact elements 18.

Figure 2:
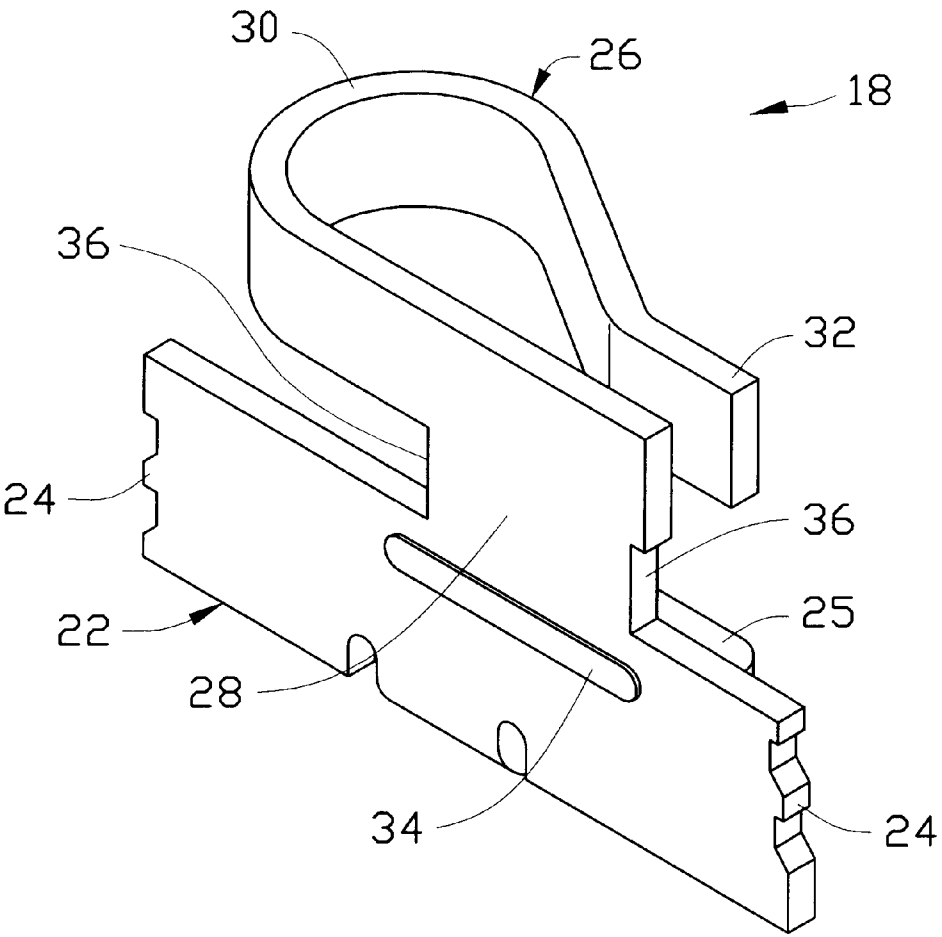
FIG. 2 is a perspective view of a contact element in accordance with a first embodiment of the present invention.
Figure 3:
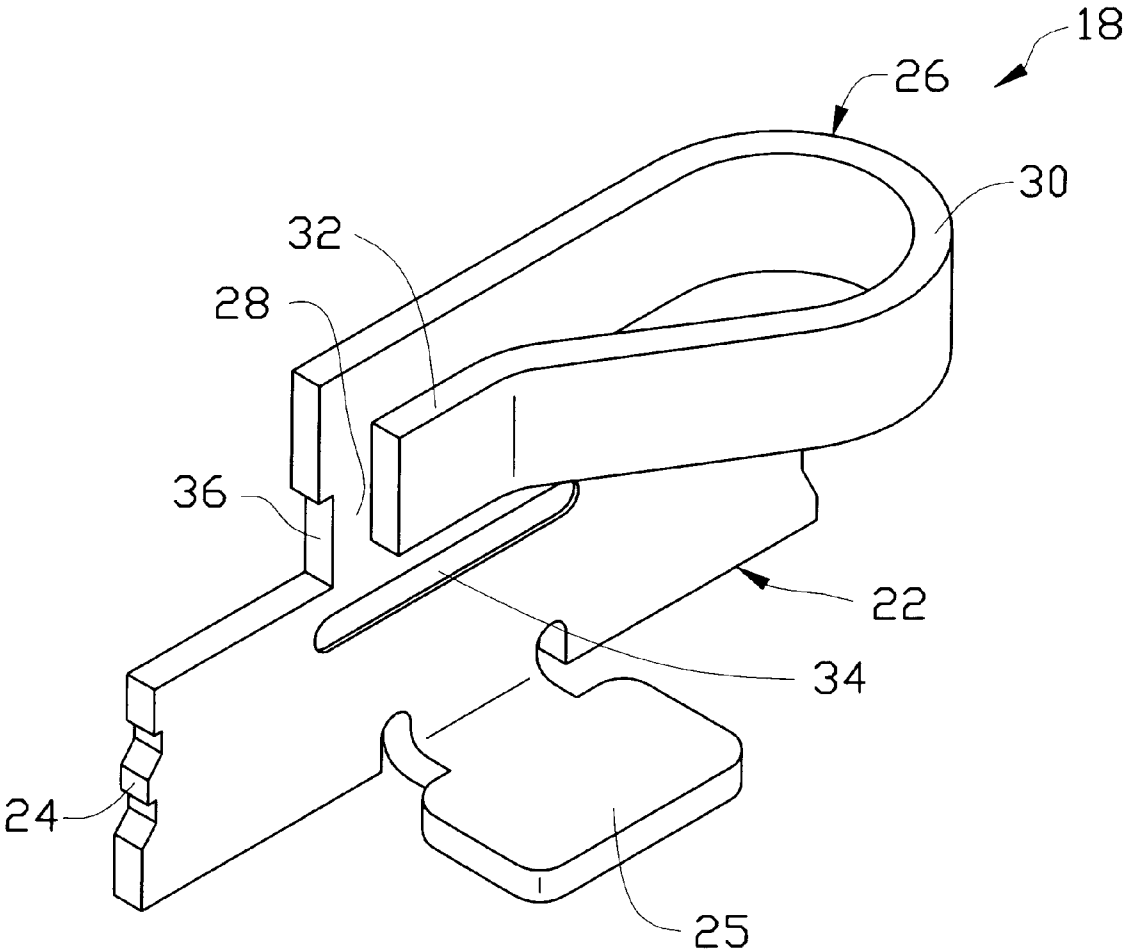
FIG. 3 is a similar to FIG. 2 but taken from a different perspective.

FIGS. 2 and 3 show a first embodiment of the contact element 18 of the present invention. The contact element 18 comprises an anchoring section 22 having barbs 24 formed on opposite edges thereof for interferentially engaging with an inside surface of the corresponding bore 16 of the base 12 thereby securely retaining the contact element 18 in the bore 16. A tail section is located below the anchoring section 22 for being soldered to the circuit board. Said tail section is a solder ball support member 25 extending from the anchoring section 22 for supporting a solder ball (not shown) thereon. The solder ball support member 25, however, does not constitute a novel part of the present invention and may be replaced with a surface-mounting section.

The contact element 18 comprises a pin engaging section 26 fixed to the anchoring section 22 by means of a reduced connection section 28. In the embodiment illustrated, the pin engaging section 26 comprises a loop portion 30 fixed to the connection section 28 and forming a resilient arm 32 opposite and spaced from the connection section 28 a distance substantially smaller than an inside diameter of the loop portion 30. The pin of the external device is initially received in but does not contact the loop portion 30. The movement of the cover 14 drives the pin into the space between the resilient arm 32 and the connection section 28 to securely engage with the arm 32 due to the resiliency thereof.

An elongate projection 34 is formed on the anchoring section 22 proximate a junction thereof with the connection section 28. The projection 34 extends transversely along the connection section 28 and preferably beyond opposite edges 36 of the connection section 28. The projection 34 may be simply formed by pressing the anchoring section 22 whereby the projection 34 is a dimple, or a notch when viewed from an opposite side. Since the connection section 28 is the only passage where wicking may occur between the anchoring section 22 and the pin engaging section 26, forming the projection 34 proximate the junction between the anchoring section 22 and the connection section 28 effectively blocks the wicking path thereby suppressing and, in some cases, eliminating the wicking problem.

Figure 4:
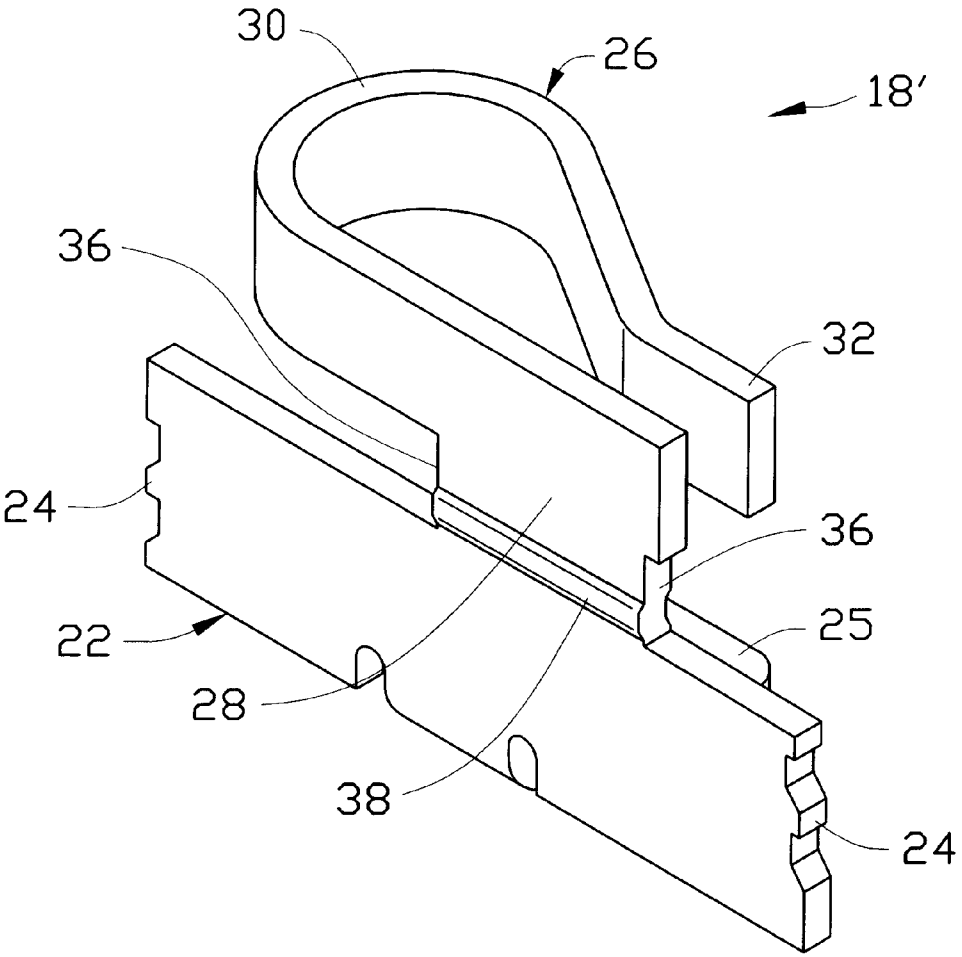
FIG. 4 is a perspective view of a contact element in accordance with a second embodiment of the present invention.
Figure 5:
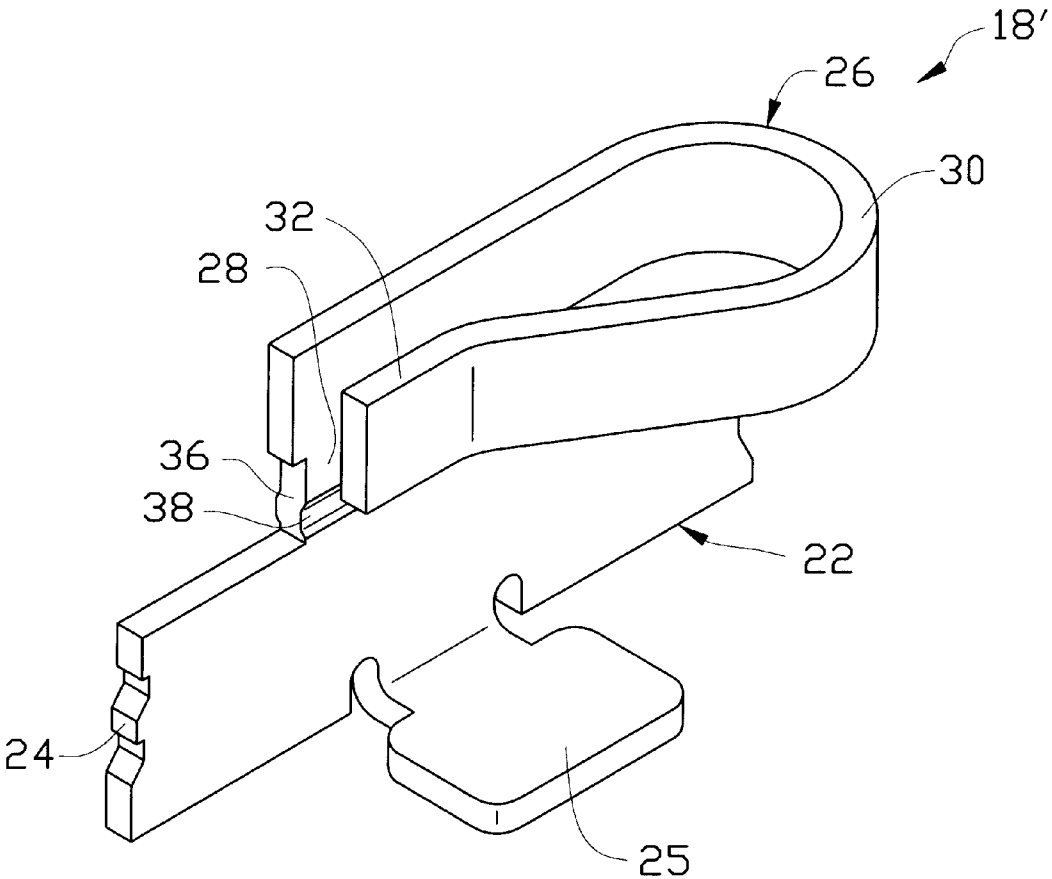
FIG. 5 is similar to FIG. 4 but taken from a different perspective.

FIGS. 4 and 5 show a second embodiment of the contact element 18' wherein the projection 34 of the first embodiment is replaced by a projection 38 formed on the connection section 28 and preferably extending between the edges 36 thereof. The projection 38 more effectively blocks the wicking path across the connection section 28 and may also be formed by means of pressing.

Figure 8:
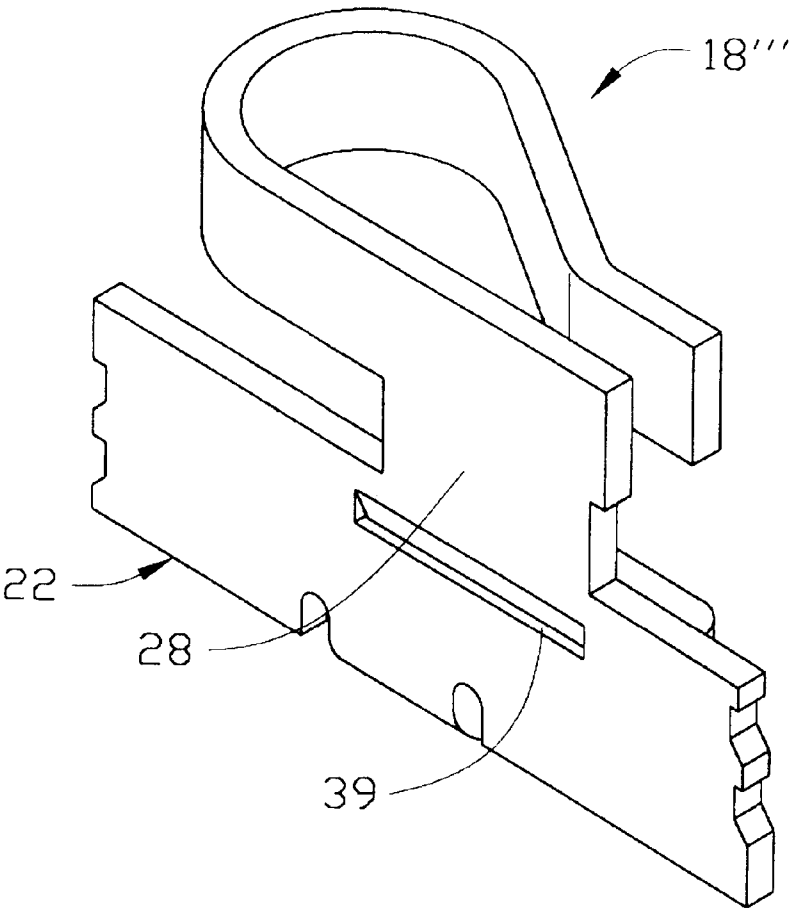
FIG. 8 is a perspective view of a contact element in accordance with a fourth embodiment of the present invention.
Figure 9:
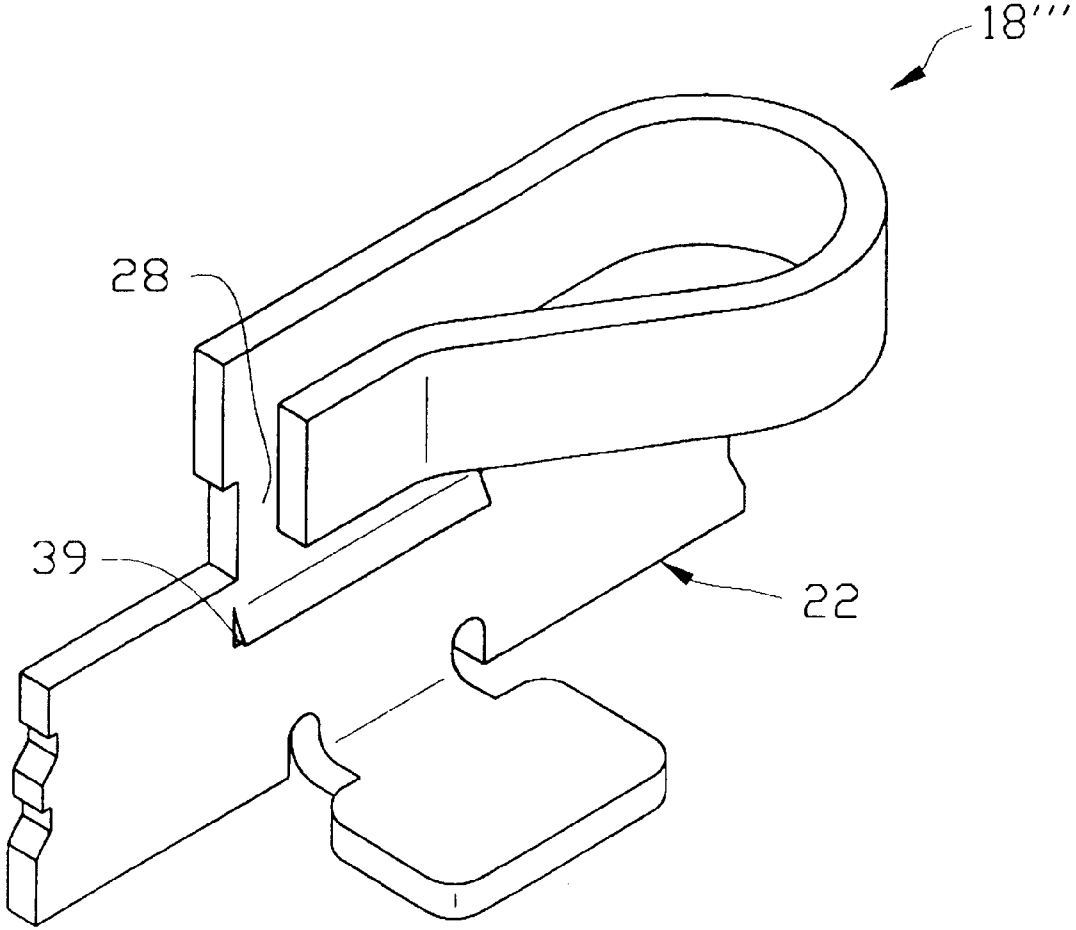
FIG. 9 is similar to FIG. 8 but taken from a different perspective.

Furthermore, forming an elongate notch, rather than a projection, provides the same effect as might be readily observed by those having ordinary skill in the art. FIGS. 8 and 9 show such an alternative option.

Figure 6:
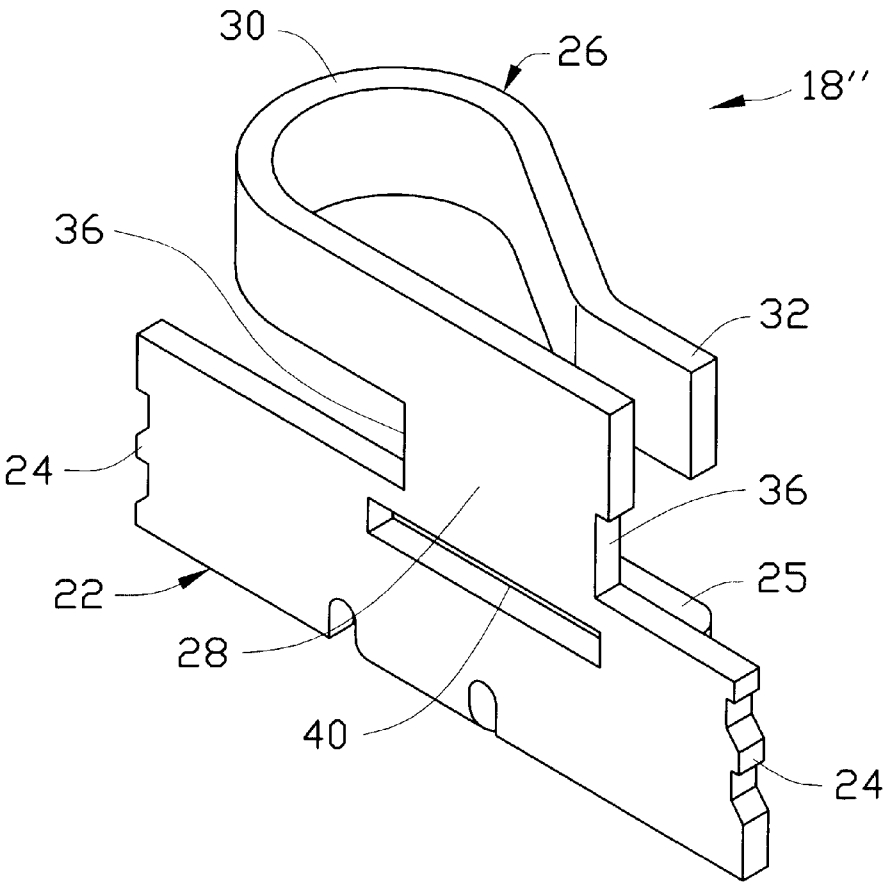
FIG. 6 is a perspective view of a contact element in accordance with a third embodiment of the present invention.
Figure 7:
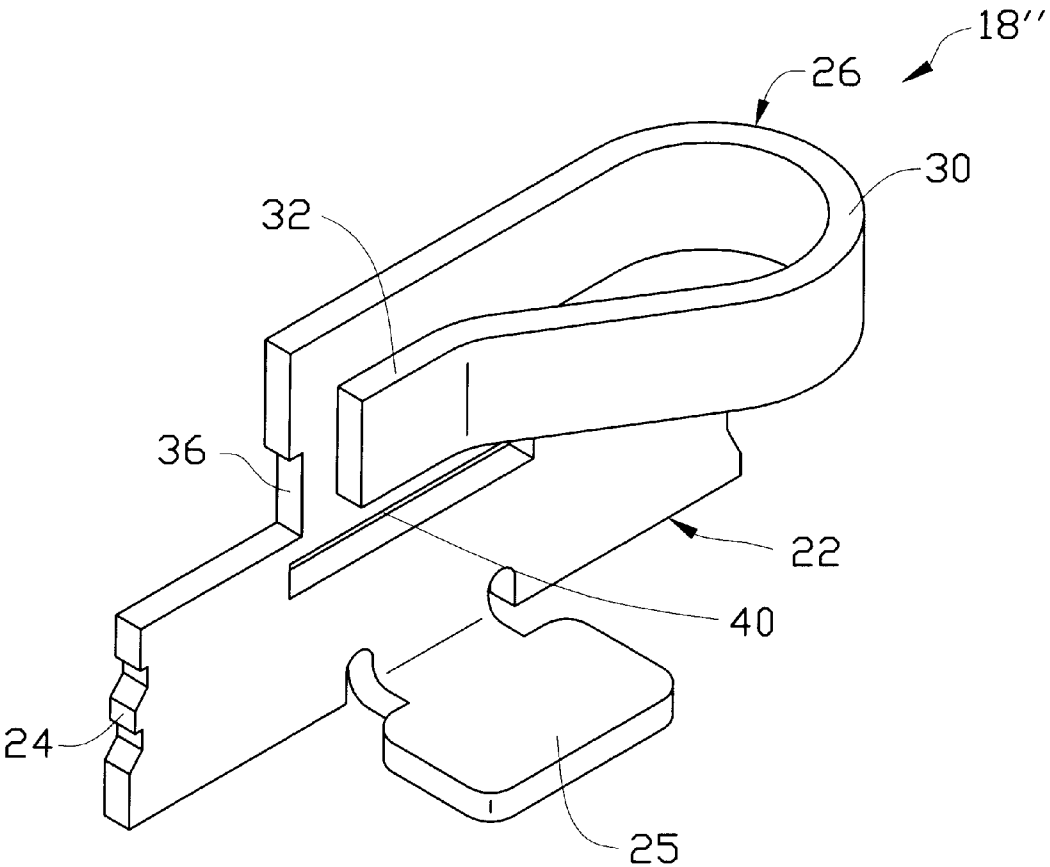
FIG. 7 is similar to FIG. 6 but taken from a different perspective.

FIGS. 6 and 7 show a third embodiment of the contact element 18" wherein the projection 34 of the first embodiment is replaced by an elongate opening 40 defined in the anchoring section 22 proximate the junction thereof with the connection section 28 thereby providing the same effect of blocking the wicking path across the connection section 28.

Furthermore, FIGS. 8 and 9 show a fourth embodiment of the contact element 18''' wherein the projection of the first embodiment is replaced by an elongate notch 39 defined in the anchoring section 22 proximate the junction thereof with the connection section 28, thereby providing the same effect of blocking the wicking path across the connection section 28.

Although the present invention has been described with reference to the preferred embodiments, it is apparent to those skilled in the art that a variety of modifications and changes may be made without departing from the scope of the present invention which is intended to be defined by the appended claims. For example, the projection, notch or opening may be formed on the pin engaging section 26 rather than the anchoring section 22.

What is claimed is:

1. A contact element adapted to be received and retained in a bore defined in a connector and soldered to a circuit board for selectively engaging with a pin of an external device to establish electrical connection between the external device and the circuit board, the contact element comprising an anchoring section adapted to be received in the bore of the connector, a tail section located below and connected to the anchoring section for being soldered to the circuit board, a pin engaging section for selectively engaging with the pin of the external device, and a connection section connecting the pin engaging section with the anchoring section, the pin engaging section comprising a loop portion and forming a resilient arm at a free end of the loop portion, the loop portion being fixed to the connection section and initially receiving the pin of the external device within the bounds of but not touching the loop portion, the resilient arm being opposite to and spaced from the connection section a distance substantially smaller than an inside diameter of the loop portion, the pin of the external device being finally moved into the space between the resilient arm and the connection section to engage with the contact element, a projection being formed on the contact element to substantially block a wicking path across the connection section from the anchoring section to the pin engaging section.

2. The contact element as claimed in claim 1, wherein the projection is formed on the anchoring section proximate a junction thereof with the connection section.

3. The contact element as claimed in claim 2, wherein the projection extends beyond opposite edges of the connection section.

4. The contact element as claimed in claim 1, wherein the projection is formed on the connection section and extends between opposite edges of the connection section.

5. The contact element as claimed in claim 1, wherein the projection is formed by means of pressing.

6. The contact element as claimed in claim 1, wherein the tail section is a solder ball support member extending from the anchoring section for supporting a solder ball thereon.

7. A contact element adapted to be received and retained in a bore defined in a connector and soldered to a circuit board for selectively engaging with a pin of an external device to establish electrical connection between the external device and the circuit board, the contact element comprising an anchoring section adapted to be received in the bore, a tail section located below the anchoring section for being soldered to the circuit board, a pin engaging section for selectively engaging with the pin of the external device, and a connection section connecting the pin engaging section with the anchoring section, the pin engaging section comprising a loop portion and forming a resilient arm at a free end of the loop portion, the loop portion being fixed to the connection section and initially receiving the pin of the external device within the bounds of but not touching the loop portion, the resilient arm being opposite to and spaced from the connection section a distance substantially smaller than an inside diameter of the loop portion, the pin of the external device being finally moved into the space between the resilient arm and the connection section to engage with the contact element, an elongate opening being formed in the contact element to substantially block a wicking path across the connection section between the pin engaging section and the anchoring section.

8. The contact element as claimed in claim 7, wherein the opening is defined in the anchoring section proximate a junction thereof with the connection section.

9. The contact element as claimed in claim 7, wherein the tail section is a solder ball support member extending from the anchoring section for supporting a solder ball thereon.

10. A contact element adapted to be received and retained in a bore defined in a connector and soldered to a circuit board for selectively engaging with a pin of an external device to establish electrical connection between the external device and the circuit board, the contact element comprising an anchoring section adapted to be received in the bore, a tail section located below the anchoring section for being soldered to the circuit board, a pin engaging section for selectively engaging with the pin of the external device, and a connection section connecting the pin engaging section with the anchoring section, the pin engaging section comprising a loop portion and forming a resilient arm at a free end of the loop portion, the loop portion being fixed to the connection section and initially receiving the pin of the external device within the bounds of but not touching the loop portion, the resilient arm being opposite to and spaced from the connection section a distance substantially smaller than an inside diameter of the loop portion, the pin of the external device being finally moved into the space between the resilient arm and the connection section to engage with the contact element, an elongate notch being formed in the contact element to substantially block a wicking path across the connection section between the pin engaging section and the anchoring section.

11. The contact element as claimed in claim 10, wherein the notch is formed in the anchoring section proximate a junction thereof with the connection section.

12. The contact element as claimed in claim 10, wherein the tail section is a solder ball support member extending from the anchoring section for supporting a solder ball thereon.

* * * * *